US010532593B2

(12) United States Patent
Suzuki

(10) Patent No.: US 10,532,593 B2
(45) Date of Patent: Jan. 14, 2020

(54) PRINTING APPARATUS WITH SLIT FORMED BETWEEN FRAME AND HOUSING

(71) Applicant: TOSHIBA TEC KABUSHIKI KAISHA, Tokyo (JP)

(72) Inventor: Akira Suzuki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/987,084

(22) Filed: May 23, 2018

(65) Prior Publication Data

US 2018/0339533 A1 Nov. 29, 2018

(30) Foreign Application Priority Data

May 25, 2017 (JP) ..... 2017-103417

(51) Int. Cl.
*B41J 29/02* (2006.01)
*B41J 11/00* (2006.01)

(52) U.S. Cl.
CPC ..... *B41J 29/02* (2013.01); *B41J 11/0045* (2013.01)

(58) Field of Classification Search
CPC ..... B41J 29/02; B41J 13/103; B41J 11/0045
See application file for complete search history.

(56) References Cited

U.S. PATENT DOCUMENTS 6,421,133 B2 7/2002 Kasai et al.
2003/0052956 A1* 3/2003 Katsuyama ..... B41J 13/103 347/108
2011/0058879 A1* 3/2011 Shiraishi ..... B41J 3/283 400/582

FOREIGN PATENT DOCUMENTS

JP H05-270079 10/1993

* cited by examiner

*Primary Examiner* — Henok D Legesse
(74) *Attorney, Agent, or Firm* — Kim & Stewart LLP

(57) ABSTRACT

A printing apparatus according to an embodiment includes a housing and a frame having a supported portion which is supported by the housing on a first side and an unsupported portion not supported by the housing on a second side. A printer is provided on the frame. An upper sheet carrying guide is provided below the frame. A lower sheet carrying guide is provided below the upper sheet carrying guide. The lower sheet carrying guide is shaped and positioned to form a gap, into which a sheet to be printed by the printer is inserted, between the upper sheet carrying guide and the lower sheet carrying guide. A stopper is provided on the upper sheet carrying guide. The stopper being shaped and positioned to abut against the lower sheet carrying guide when the frame is deformed around the supported portion within an elastic deformation range of the frame.

20 Claims, 9 Drawing Sheets

PRINTING APPARATUS WITH SLIT FORMED BETWEEN FRAME AND HOUSING

CROSS-REFERENCE TO RELATED APPLICATION

This application is based upon and claims the benefit of priority from Japanese Patent Application No. 2017-103417, filed May 25, 2017, the entire contents of which are incorporated herein by reference.

FIELD

Embodiments described herein relate generally to a printing apparatus.

BACKGROUND

A printing apparatus for printing on a wide sheet such as a check or a statement sheet is known. Such a printing apparatus may include a slit having a gap into which a sheet can be inserted into one side of a carrying path of the sheet. Because the slit is provided in the printing unit, the printing unit has a cantilever structure and when accidental shock or load is applied from above, there is a concern that a frame of the printing unit becomes deformed.

DETAILED DESCRIPTION

Embodiments provide a printing apparatus in which a frame of a cantilever structure can be prevented from being non-elastically deformed.

A printing apparatus according to an embodiment includes a housing and a frame having a supported portion which is supported by the housing on a first side and an unsupported portion not supported by the housing on a second side. A printer is provided on the frame. An upper sheet carrying guide is provided below the frame. A lower sheet carrying guide is provided below the upper sheet carrying guide. The lower sheet carrying guide is shaped and positioned to form a gap, into which a sheet to be printed by the printer is inserted, between the upper sheet carrying guide and the lower sheet carrying guide. A stopper is provided on the upper sheet carrying guide. The stopper being shaped and positioned to abut against the lower sheet carrying guide when the frame is deformed around the supported portion within an elastic deformation range of the frame.

Hereinafter, a printing apparatus 1 according to an embodiment will be described with reference to FIGS. 1 to 9.

Figure 1:
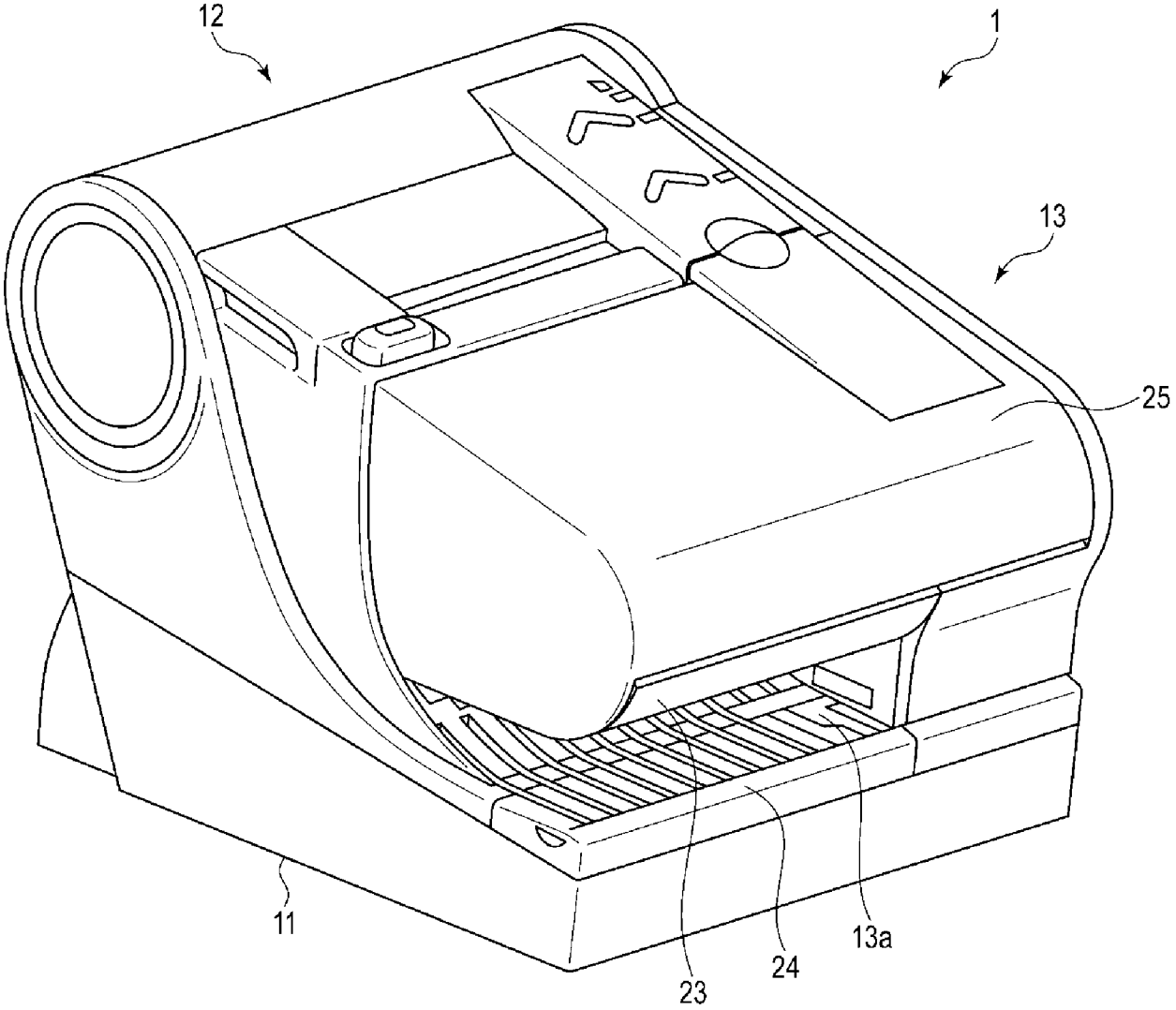
FIG. 1 is a perspective view illustrating a printing apparatus according to an embodiment.
Figure 2:
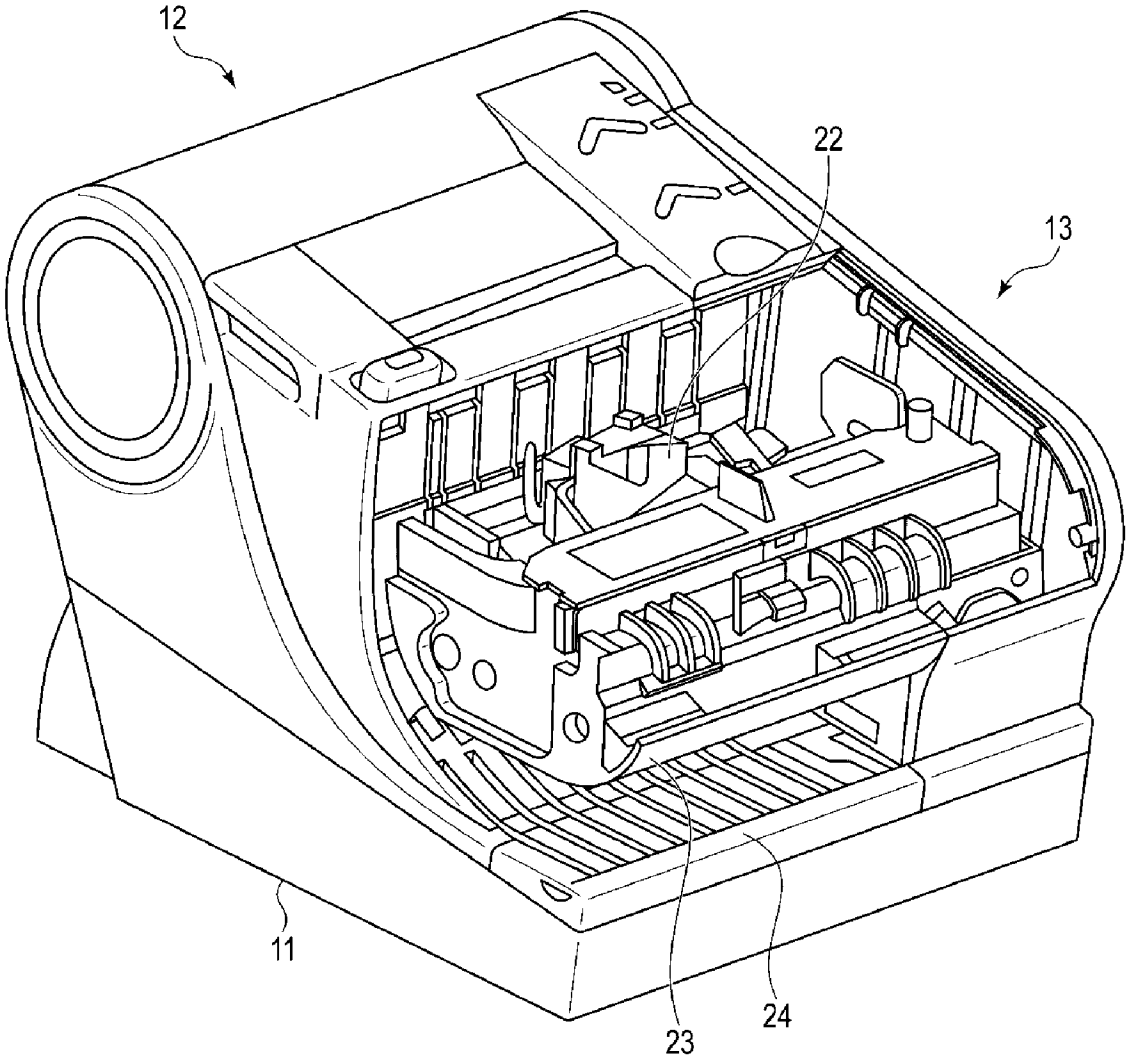
FIG. 2 is a perspective view illustrating the printing apparatus in which a cover is removed.
Figure 3:
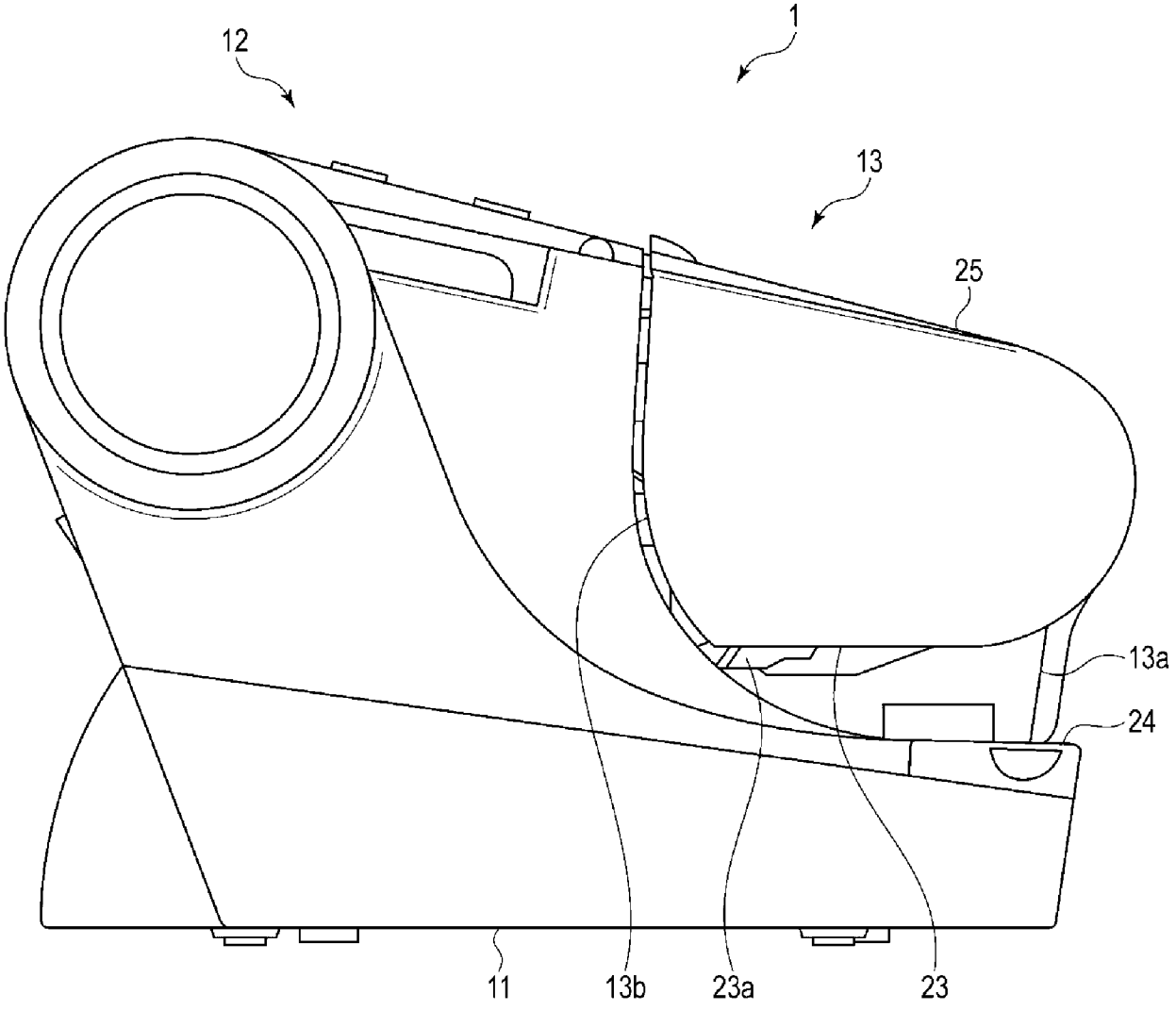
FIG. 3 is a side view of the printing apparatus.
Figure 4:
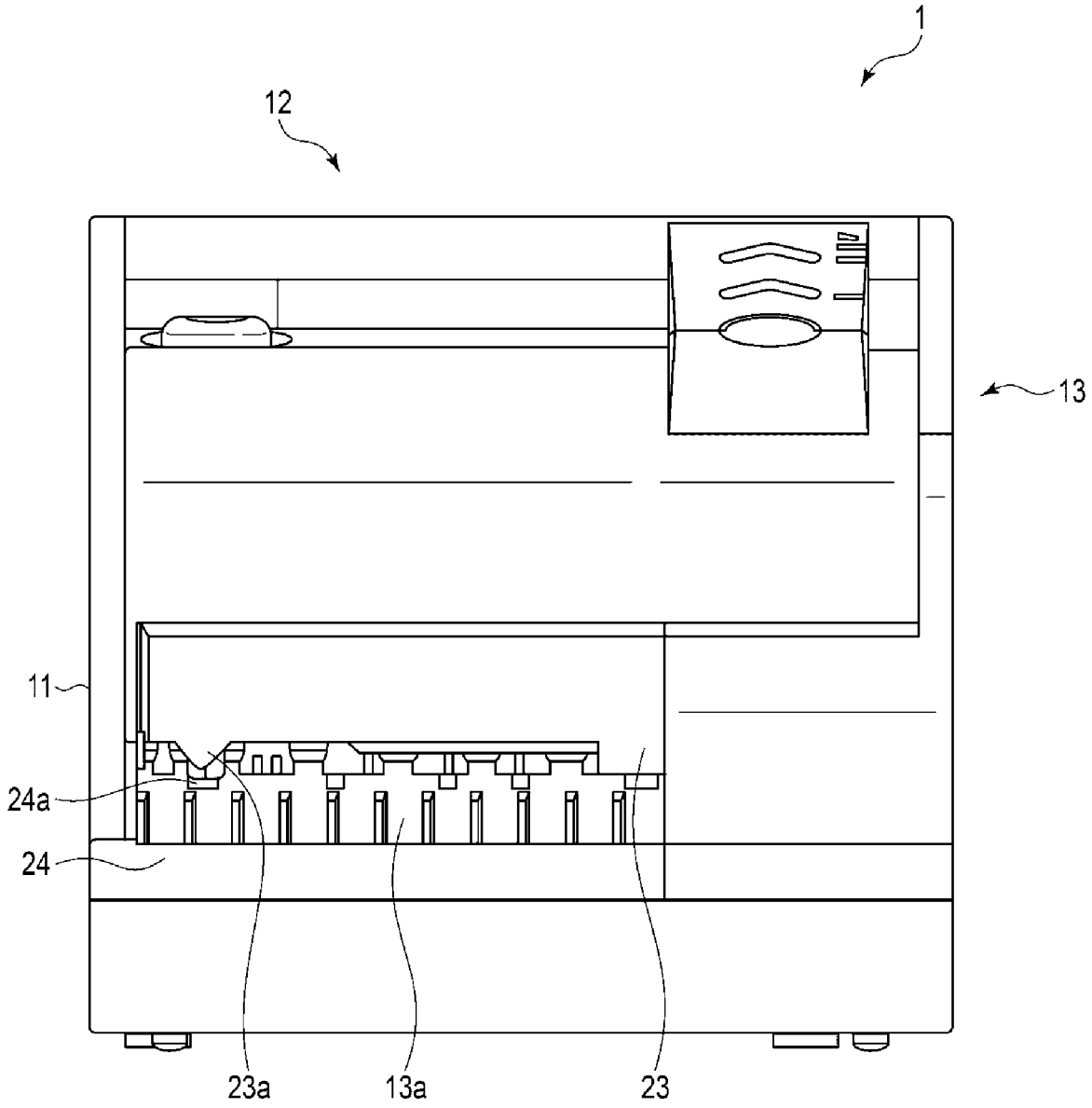
FIG. 4 is a front view of the printing apparatus.
Figure 5:
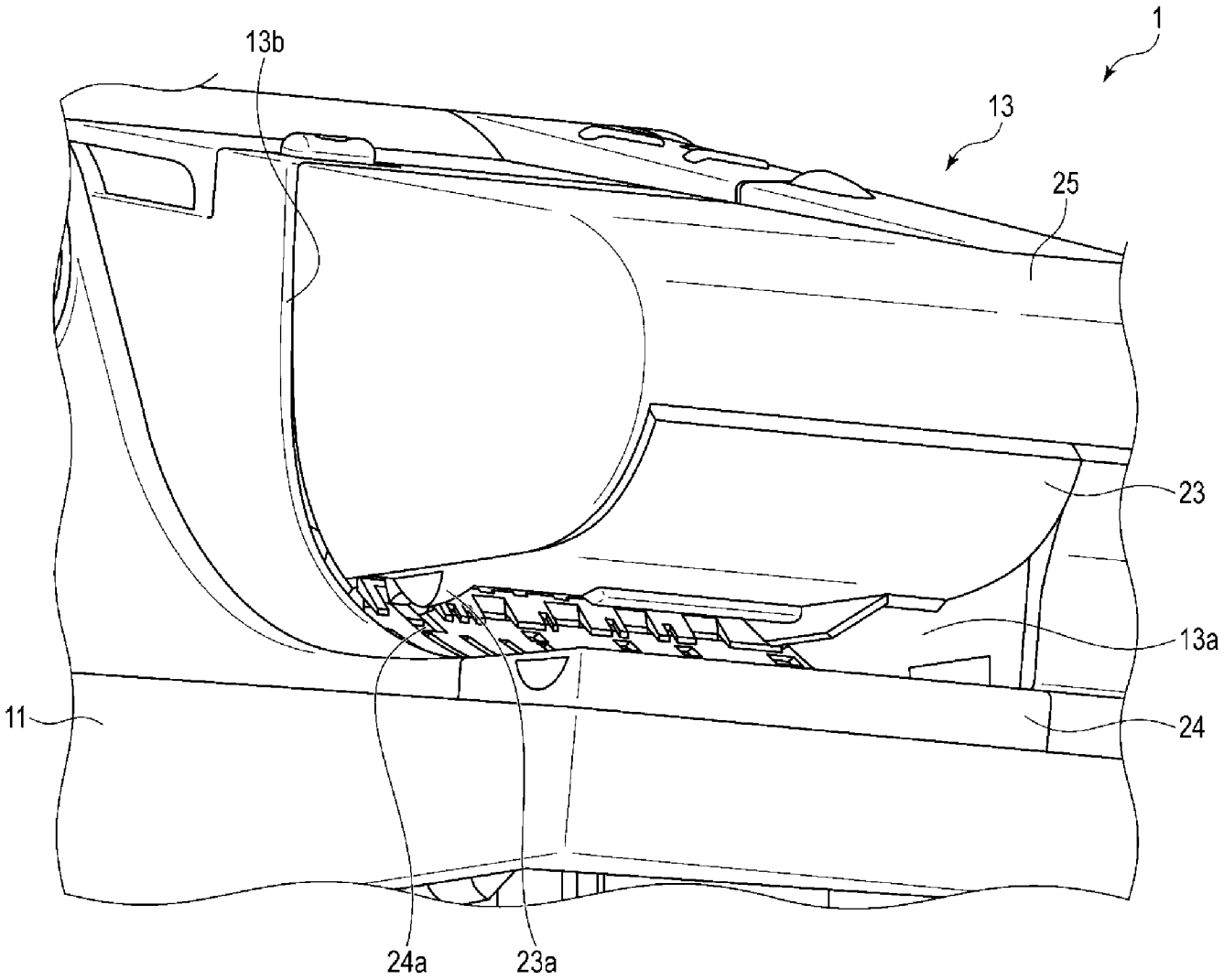
FIG. 5 is a detailed perspective view of a main portion of the printing apparatus.
Figure 6:
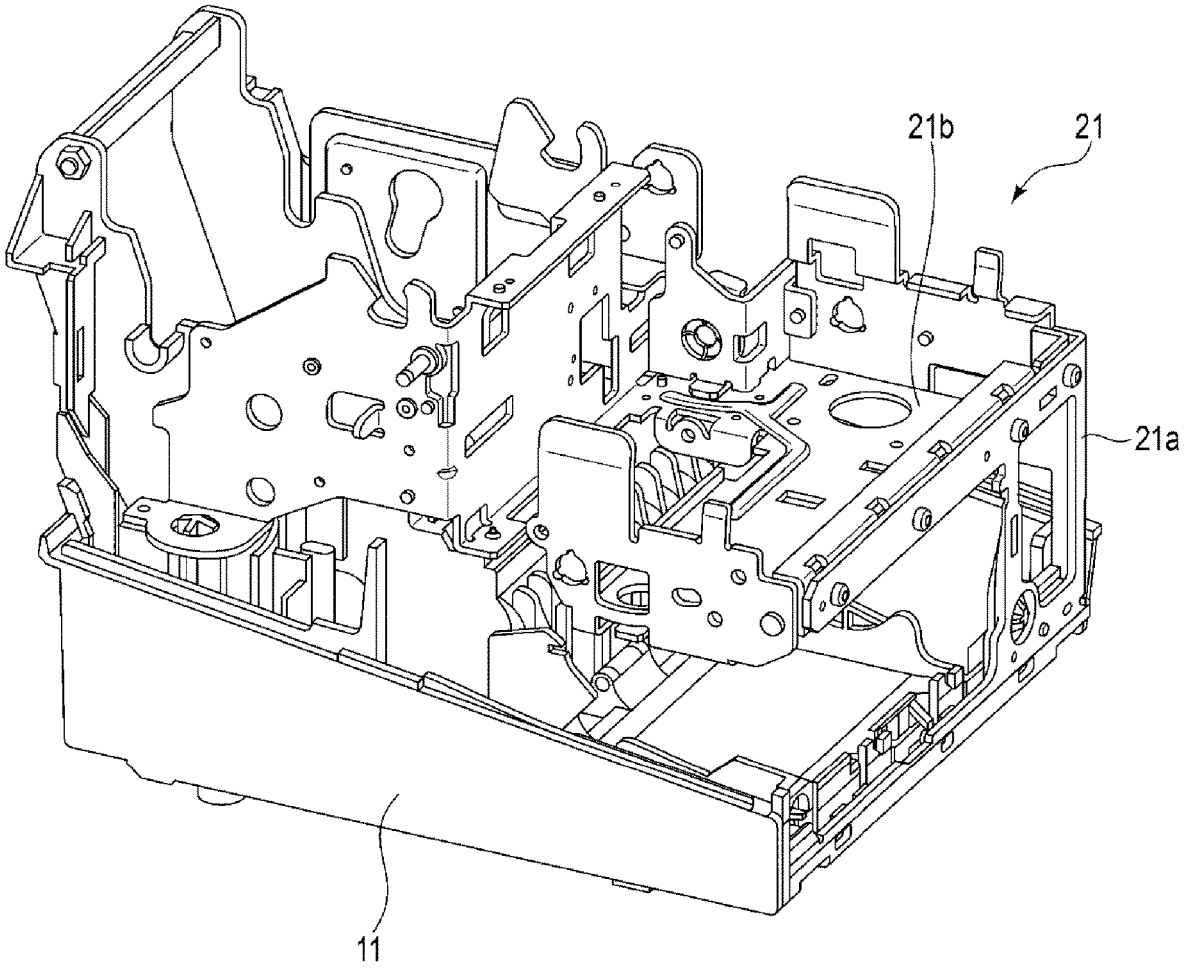
FIG. 6 is a perspective view of a housing and a frame of the printing apparatus.
Figure 7:
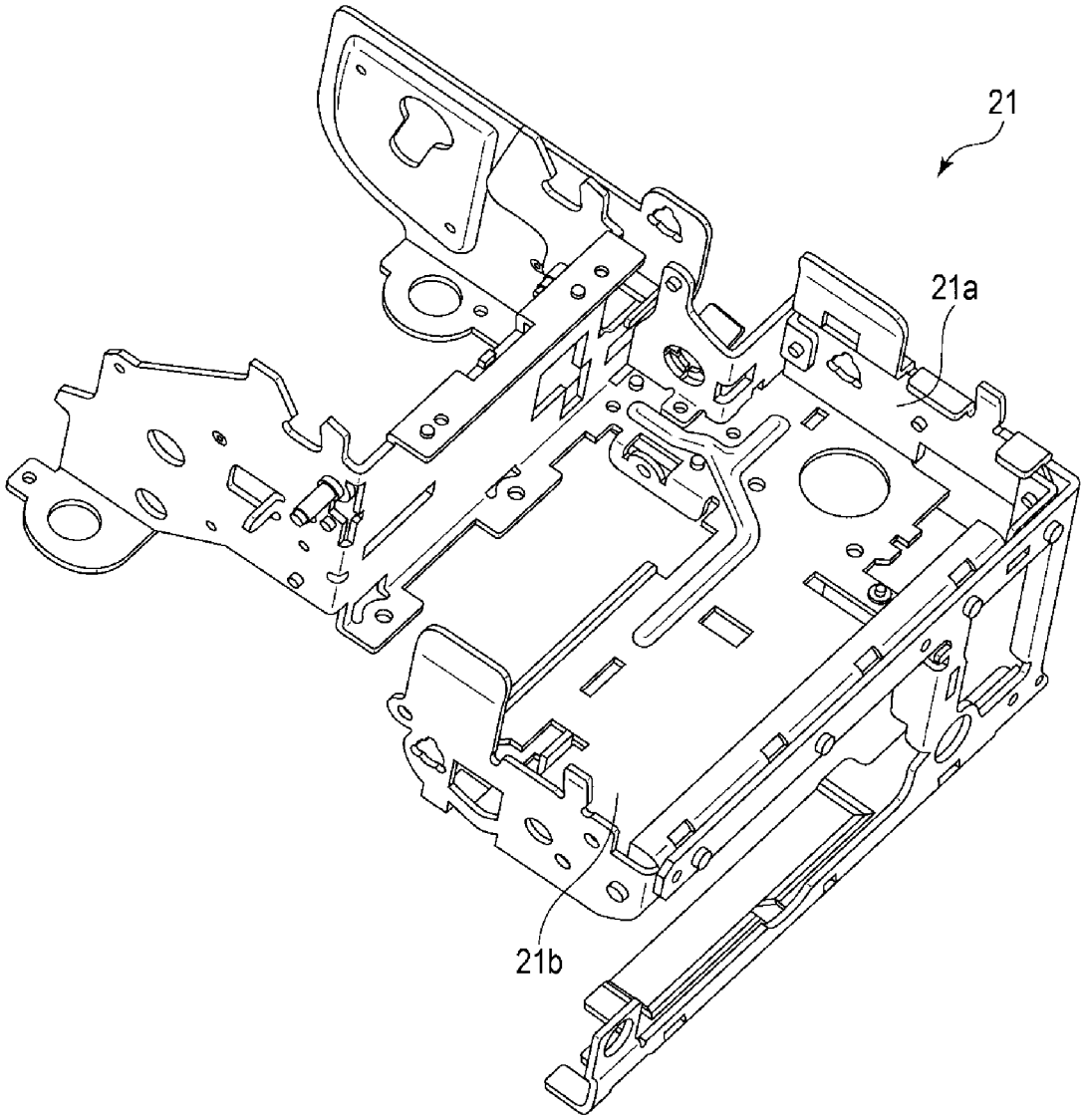
FIG. 7 is a perspective view of the frame.
Figure 8:
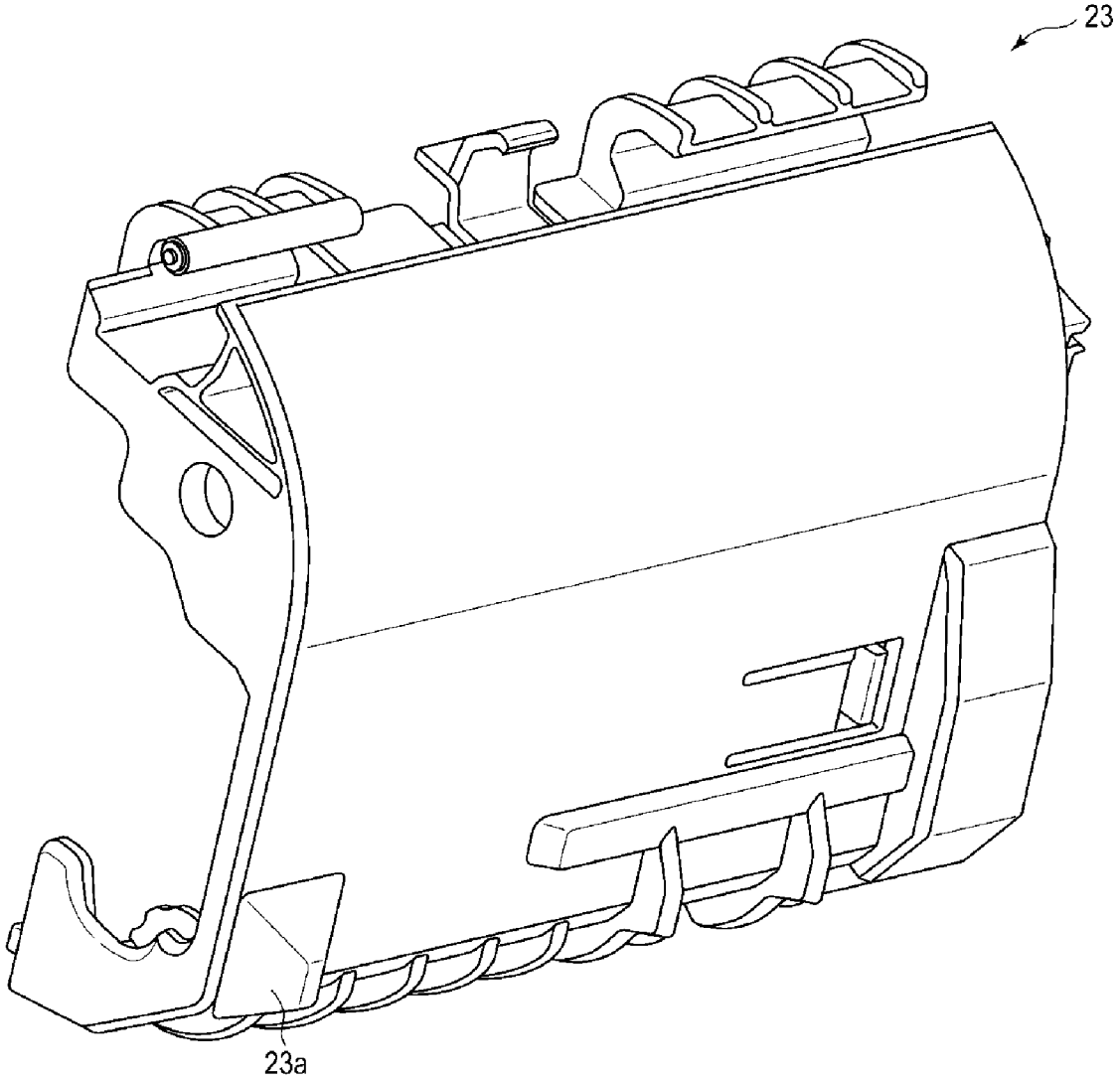
FIG. 8 is a perspective view of an upper sheet carrying guide used in the printing apparatus.
Figure 9:
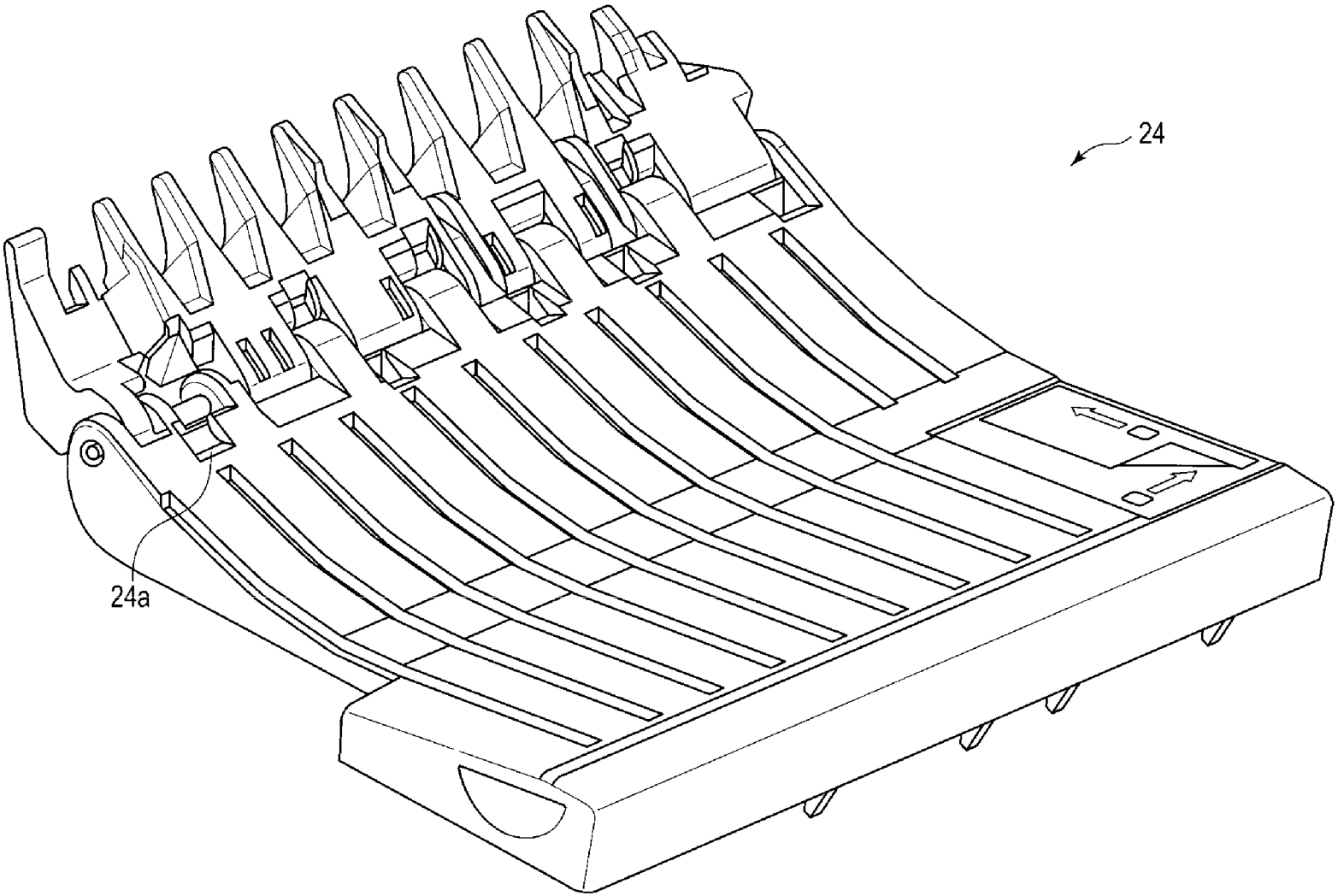
FIG. 9 is a perspective view of a lower sheet carrying guide used in the printing apparatus.

FIG. 1 is a perspective view of the printing apparatus 1 according to the embodiment and FIG. 2 is a perspective view of the printing apparatus 1 in which a cover 25 of a second printer 13 is removed. FIG. 3 is a side view of the printing apparatus 1. FIG. 4 is a front view of the printing apparatus 1. FIG. 5 is a perspective view illustrating the second printer 13 of the printing apparatus 1. FIG. 6 is a perspective view of a housing 11 and a frame 21 of the printing apparatus 1. FIG. 7 is a perspective view of the frame 21. FIG. 8 is a perspective view of an upper sheet carrying guide 23 of the second printer 13. FIG. 9 is a perspective view of a lower sheet carrying guide 24 of the second printer 13. Moreover, in the embodiment, the printing apparatus 1 will be described below with the second printer 13 provided on a front side.

As illustrated in FIGS. 1 to 5, the printing apparatus 1 includes the housing 11, a first printer 12 provided in the housing 11, and the second printer 13 also provided in the housing 11. The printing apparatus 1 prints on roll paper with the first printer 12 and prints on a wide sheet with the second printer 13. The printing apparatus 1 is used, for example, with a point-of-sale ("POS") terminal.

The housing 11 supports the first printer 12 and the second printer 13. Electrical components and the like are accommodated in the housing 11.

The first printer 12 prints on, for example, the paper roll to issue a receipt. The first printer 12 includes a feed device for feeding the paper roll, a paper discharge port for discharging the fed paper roll, a print head for printing on the paper roll, a cutter unit for cutting the paper roll, and the like. For example, the paper roll is thermal paper and the print head is a thermal head.

The second printer 13 prints on a sheet such as a check or a statement paper. The second printer 13 includes the frame 21 that is supported by the housing 11, a print head 22 that is held by the frame 21, the upper sheet carrying guide 23 provided in the frame 21, the lower sheet carrying guide 24 provided in the housing 11, and the cover 25 that covers an upper side of the frame 21.

As illustrated in FIGS. 6 and 7, the frame 21 is fixed to the housing 11. The frame 21 is made of a metal material. The frame 21 includes a supported portion 21*a* that is fixed to the housing 11, and a holding portion 21*b*. The holding portion 21*b* holds the print head 22 and the upper sheet carrying guide 23.

The supported portion 21*a* supports the holding portion 21*b*. The print head 22 and the upper sheet carrying guide 23 are provided on the holding portion 21*b*. A part of the supported portion 21*a* may include, for example, a frame of the first printer 12.

The holding portion 21*b* holds the print head 22 and the upper sheet carrying guide 23. One end side of the holding portion 21*b* is integrally attached to the supported portion 21*a* and is thus fixed to the housing 11 via the supported portion 21*a*. The other end of the holding portion 21*b* is a free end. That is, the holding portion 21*b* has a so-called cantilever structure and holds the print head 22 and the upper sheet carrying guide 23.

In other words, in the frame 21, the supported portion 21*a* is fixed to the housing 11 so that the holding portion 21*b* holds the print head 22 and the upper sheet carrying guide 23 with the cantilever structure.

The print head 22 prints on the sheet carried between the upper sheet carrying guide 23 and the lower sheet carrying guide 24. The print head 22 is, for example, a dot matrix head.

The upper sheet carrying guide 23 is made of a resin material. As illustrated in FIG. 8, the upper sheet carrying guide 23 covers peripheries of the frame 21 and the printing unit 22. The upper sheet carrying guide 23 is positioned on a side of the housing 11 and above the lower sheet carrying guide 24. The upper sheet carrying guide 23 is spaced relative to the lower sheet carrying guide 24, thereby forming a predetermined gap extending from to the side of the housing 11. Moreover, the gap between the upper sheet carrying guide 23 and the lower sheet carrying guide 24 has a width such that the sheet and the fingers of an operator can be positioned therein. In addition, a gap between the upper sheet carrying guide 23 and the housing 11 has a width such that the sheet can be positioned therein so that the sheet can be printed by the print head 22.

In addition, the upper sheet carrying guide 23 includes a stopper 23*a* on a part of the lower surface. When an external force is applied from the upper side, the holding portion 21*b* of the frame 21 is deformed so as to be rotated downward around the supported portion 21*a*. As the frame 21 is elastically deformed, the stopper 23*a* abuts against the lower sheet carrying guide 24.

The stopper 23*a* is provided on the lower surface of the upper sheet carrying guide 23 on an end portion side opposite to the end portion of the holding portion 21*b* connected to the supported portion 21*a*. In other words, the stopper 23*a* is provided at a position which is on the lower surface of the upper sheet carrying guide 23 and is away from a center of rotation of the holding portion 21*b* when the frame 21 is deformed by the external force from above.

The stopper 23*a* includes a planar surface which extends in the horizontal direction. The stopper 23*a* also includes a side surface inclined relative to a carrying direction of the sheet. That is, a width of the stopper 23*a* in the carrying direction of the sheet gradually decreases from the lower surface towards a leading end of the upper sheet carrying guide 23, and the leading end is formed in a planar shape. In addition, the stopper 23*a* is positioned to form a gap, into which the sheet can be inserted, between the stopper 23*a* and a portion of the upper surface of the lower sheet carrying guide 24 that faces the stopper 23*a*. A distance between the stopper 23*a* and the lower surface of the upper sheet carrying guide 23 can be appropriately set as long as the stopper 23*a* is capable of abutting against the lower sheet carrying guide 24 in a region in which the frame 21 is elastically deformed when the frame 21 is deformed by the external force applied from above so as to be rotated downward. The stopper 23*a* is, for example, provided on the end portion side of the upper sheet carrying guide 23 and on the lower surface on the housing 11 side.

The lower sheet carrying guide 24 is made of a resin material. The lower sheet carrying guide 24 is provided in the housing 11. The lower sheet carrying guide 24 extends from the lower side of the upper sheet carrying guide 23 to the lower side of the print head 22. The lower sheet carrying guide 24 is fixed to the housing 11. The lower sheet carrying guide 24 is provided in the housing 11 with a predetermined space between the print head 22 and the upper sheet carrying guide 23. As a specific example, as illustrated in FIG. 9, the upper surface of the lower sheet carrying guide 24 is formed with a contour that matches a front side of the lower surface of the upper sheet carrying guide 23 extending in the horizontal direction. The upper surface of the lower sheet carrying guide 24 also has a curvature that extends towards the lower surface of the upper sheet carrying guide 23, in a direction towards the print head 22.

That is, the gap between the upper sheet carrying guide 23 and the lower sheet carrying guide 24 is large on the front side of the printing apparatus 1 so that the fingers of a user can be inserted, and gradually decreases towards the back side of the upper sheet carrying guide 23 in a rearward direction.

In addition, the lower sheet carrying guide 24 has a receiving portion 24*a* for receiving the stopper 23*a* at a position facing the stopper 23*a* of the upper sheet carrying guide 23 on the upper surface. The receiving portion 24*a* abuts against the stopper 23*a* and restricts the movement of the stopper 23*a* when the holding portion 21*b* of the frame 21 is deformed so as to be rotated downward around the supported portion 21*a* and when the frame 21 is in a region to be elastically deformed. In the receiving portion 24*a*, a surface direction of the upper surface abutting against the stopper 23*a* extends in the horizontal direction. For example, the receiving portion 24*a* is disposed at a curved portion of the upper surface of the lower sheet carrying guide 24 and a surface abutting against the stopper 23*a* is formed in a planar shape.

According to the printing apparatus 1 configured as described above, the upper sheet carrying guide 23 is disposed with a gap between the housing 11 and the lower sheet carrying guide 24. Further, the holding portion 21*b*, which holds the print head 22 and the upper sheet carrying guide 23 of the frame 21, has the cantilever structure. Therefore, in the printing apparatus 1, one side and the front side of the second printer 13 are opened by the gap. That is, the second printer 13 has an opening portion 13*a* on the front side and a slit 13*b* on the side, and includes a sheet feeding path extending from the front side to the upper side of the printing apparatus 1, and extending to the print head 22. Therefore, the user inserts the sheet from the front side of the second printing apparatus 13, causes the region of the sheet to be printed to face the print head 22, and performs an external command for printing to the printing apparatus 1, so that the second printing apparatus 13 can print on the sheet.

In addition, in such a printing apparatus 1, since the second printer 13 includes the opening and the slit 13*b* into which the sheet can be inserted, the frame 21 of the second printer 13 has the cantilever structure. Therefore, when shock or a load is applied from above the second printer 13, the holding portion 21*b* of the frame 21 is deformed so as to be rotated downward around the supported portion 21*a*. However, the second printer 13 has the stopper 23*a* in the upper sheet carrying guide 23 and a receiving portion 24*a* in the lower sheet carrying guide 24. Therefore, when the holding portion 21*b* is deformed elastically deformed downward, the stopper 23*a* abuts against the receiving portion 24*a* and the movement of the upper sheet carrying guide 23, that is, the deformation of the frame 21, is suppressed.

In other words, the deformation of the frame 21 in a state where the stopper 23*a* abuts against the receiving portion 24*a* remains in a region in which the deformation is performed by the elastic deformation, so that non-elastic deformation is avoided. Thus, the amount of the deformation of the frame 21 until the stopper 23*a* abuts against the receiving portion 24*a* is the amount that elastically deforms but is not extensive enough to be a damaging, i.e., non-elastic deformation. As a result, when the application of the external force to the second printer 13 is released, the frame 21 is restored to an original shape thereof. As described above, in the printing apparatus 1, the deformation amount of the frame 21 having the cantilever structure is suppressed by the stopper 23*a* so that it is possible to prevent the occurrence of troubles due to the non-elastic deformation of the frame 21.

In addition, since the stopper 23*a* has a structure in which the surface of the sheet in the carrying direction is inclined, even if the inserted sheet is proximate to the stopper 23*a*, the inclined surface guides the sheet downward. Therefore, it is possible to prevent the stopper 23*a* from obstructing movement of the sheet inserted from the opening portion 13*a*.

In addition, since the abutting surface of the stopper 23*a* protrudes from the upper sheet carrying guide 23 and the receiving portion 24*a* is a recess in the lower sheet carrying guide 24, the receiving portion 24*a* can reliably restrict the movement of the stopper 23*a*. That is, the stopper 23*a* is guided into the receiving portion 24*a* so that the frame 21 can be prevented from being deformed in a direction that would result in non-elastic deformation.

As described above, according to the printing apparatus 1 of the embodiment, even with the second printer 13 including the frame 21 having the cantilever structure, the non-elastic deformation of the frame 21 is suppressed by the stopper 23*a*. Therefore, even when the external force is applied to the printing apparatus 1, the frame 21 having the cantilever structure can be prevented from being damaged.

Moreover, the embodiment is not limited to the example described above. For example, the positions of the stopper 23*a* and the receiving portion 24*a* described above are not limited to the positions described above. For example, the stopper 23*a* and the receiving portion 24*a* may be provided on a side at which the frame 21 is fixed to the housing 11. In addition, the receiving portion 24*a* may be provided at a portion at which the upper surface of the lower sheet carrying guide 24 is a planar shape. However, when the holding portion 21*b* of the frame 21 is moved in the rotating direction, even when the stopper 23*a* moves at the same rotating angle by the configuration of the embodiment described above, the moving amount of the holding portion 21*b* downward is large. Therefore, the height of the stopper 23*a* may be lowered. Therefore, it is preferable that the stopper 23*a* is disposed at the position at which the height of the stopper 23*a* is lowered.

According to the printing apparatus of at least one embodiment described above, even when the external force is applied, it is possible to prevent the frame 21 having the cantilever structure from being non-elastically deformed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing apparatus comprising:

a housing;

a frame having a supported portion which is supported by the housing on a right side of the frame and an unsupported portion not supported by the housing on a left side of the frame, wherein the frame is shaped and positioned to form a slit between the left side of the frame and the housing;

a printer provided on the frame;

an upper sheet carrying guide provided below the frame;

a lower sheet carrying guide provided below the upper sheet carrying guide, the lower sheet carrying guide being shaped and positioned to form a gap between the upper sheet carrying guide and the lower sheet carrying guide; and a stopper provided on the upper sheet carrying guide, wherein the stopper abuts against the lower sheet carrying guide when the frame is deformed around the supported portion within an elastic deformation range of the frame.

2. The apparatus according to claim 1, wherein the lower sheet carrying guide includes a receiving portion against which the stopper abuts when the frame is deformed around the supported portion.

3. The apparatus according to claim 2, wherein the stopper is provided on a lower surface of the upper sheet carrying guide on the unsupported portion of the frame.

4. The apparatus according to claim 3, wherein the receiving portion is a recess in the lower sheet carrying guide.

5. The apparatus according to claim 3, wherein:

the stopper protrudes from the upper sheet carrying guide, and the receiving portion is a recess in the lower sheet carrying guide shaped and positioned to restrict movement of the stopper when the frame is deformed around the supported portion within the elastic deformation range of the frame.

6. The apparatus according to claim 1, wherein a surface of the stopper in a feeding direction of the sheet is inclined relative to the feeding direction in the gap between the upper sheet carrying guide and the lower sheet carrying guide.

7. The apparatus according to claim 1, wherein the printer is a first printer configured to print on the sheet inserted into the gap, and the apparatus further comprises a second printer configured to print on a paper roll.

8. The apparatus according to claim 7, wherein:

the first printer includes a dot matrix print head, and the second printer includes a thermal print head.

9. The apparatus according to claim 1, wherein the gap has a width between the upper sheet carrying guide and the lower sheet carrying guide that decreases in a direction from a front of the apparatus towards a rear of the apparatus.

10. The apparatus according to claim 1, wherein the stopper is shaped and positioned to abut against the lower sheet carrying guide when the frame is deformed around the supported portion due to a force applied from an upper side of the apparatus.

11. A method of preventing damage from a force applied to a printing apparatus that includes a housing, a frame having a supported portion which is supported by the housing on a right side of the frame and an unsupported portion not supported by the housing on a left side of the frame, wherein the frame is shaped and positioned to form a slit between the left side of the frame and the housing, a printer provided on the frame, an upper sheet carrying guide provided below the frame, and a lower sheet carrying guide provided below the upper sheet carrying guide, the lower sheet carrying guide being shaped and positioned to form a gap between the upper sheet carrying guide and the lower sheet carrying guide, the method comprising:

providing a stopper on the upper sheet carrying guide such that the stopper abuts against the lower sheet carrying guide when the frame is deformed around the supported portion within an elastic deformation range of the frame due to the force.

12. The method according to claim 11, further comprising:

providing a receiving portion on the lower sheet carrying guide at a position so that the stopper abuts the receiving portion when the frame is deformed around the supported portion due to the force.

13. The method according to claim 12, wherein the stopper is provided on a lower surface of the upper sheet carrying guide on the unsupported portion of the frame.

14. The method according to claim 13, wherein the receiving portion is a recess in the lower sheet carrying guide.

15. The method according to claim 13, wherein:

the stopper protrudes from the upper sheet carrying guide, and the receiving portion is a recess in the lower sheet carrying guide shaped and positioned to restrict movement of the stopper when the frame is deformed around the supported portion within the elastic deformation range of the frame.

16. The method according to claim 11, wherein a surface of the stopper in a feeding direction of the sheet is inclined relative to the feeding direction in the gap between the upper sheet carrying guide and the lower sheet carrying guide.

17. The method according to claim 11, wherein the stopper abuts against the lower sheet carrying guide when the frame is deformed around the supported portion due to the force applied from an upper side of the apparatus.

18. The method according to claim 11, wherein the stopper is positioned on the upper sheet carrying guide at a position away from a center of rotation of the unsupported portion of the frame when the unsupported portion of the frame deforms.

19. The method according to claim 11, further comprising:

providing a receiving portion on the lower sheet carrying guide; and when the frame is deformed around the supported portion due to the force, guiding the stopper into the receiving portion with the surfaces of the receiving portion to limit the deformation of the frame within the elastic deformation range of the frame.

20. A printing apparatus comprising:

a housing;

a frame having a supported portion which is supported by the housing on a right side of the frame and an unsupported portion not supported by the housing on a let side of the frame, wherein the frame is shaped and positioned to form a slit between the left side of the frame and the housing;

a printer provided on the frame;

an upper sheet carrying guide provided below the frame;

a lower sheet carrying guide provided below the upper sheet carrying guide, the lower sheet carrying guide being shaped and positioned to form a gap between the upper sheet carrying guide and the lower sheet carrying guide; and a stopper provided on the upper sheet carrying guide, wherein the stopper abuts against the lower sheet carrying guide when the frame is deformed around the supported portion within an elastic deformation range of the frame due to a force applied to the frame.

* * * * *